US008448941B2

(12) United States Patent
Narikiyo

(10) Patent No.: US 8,448,941 B2
(45) Date of Patent: May 28, 2013

(54) IMAGE FORMING APPARATUS

(75) Inventor: Takahisa Narikiyo, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 13/042,544

(22) Filed: Mar. 8, 2011

(65) Prior Publication Data

US 2011/0221124 A1 Sep. 15, 2011

(30) Foreign Application Priority Data

Mar. 15, 2010 (JP) ..... 2010-057343

(51) Int. Cl.
*B65H 29/00* (2006.01)
*B65H 39/10* (2006.01)

(52) U.S. Cl.
USPC ..... 271/185; 271/291

(58) Field of Classification Search
USPC ..... 271/186, 65, 175, 184, 185, 225, 271/291; 399/364
See application file for complete search history.

(56) References Cited

U.S. PATENT DOCUMENTS 7,185,962 B2 * 3/2007 Takahashi et al. ..... 347/14
7,379,678 B2 * 5/2008 Motoyama et al. ..... 399/16
7,637,497 B2 * 12/2009 Kusama ..... 271/186
7,657,219 B2 2/2010 Taniguchi et al.
7,869,755 B2 * 1/2011 Sano et al. ..... 399/367
2003/0197325 A1 * 10/2003 Ahn ..... 271/186
2008/0246291 A1 * 10/2008 Tonami ..... 294/65.5

FOREIGN PATENT DOCUMENTS

JP 01-145975 6/1989
JP 2005-047652 2/2005
JP 2005-272070 10/2005
JP 2006-021903 1/2006
JP 2007-099480 A 4/2007

* cited by examiner

*Primary Examiner* — Patrick Cicchino
(74) *Attorney, Agent, or Firm* — Renner, Otto, Boisselle & Sklar, LLP

(57) ABSTRACT

An image forming apparatus including a pair of rollers that rotate, that selectively carries out forward direction transport and switchback transport, including a guide member provided at a downstream side from the rollers in the forward direction transport that moves to either a first position or a second position, and a control portion causing the guide member to move to the first position during the forward direction transport and causing the guide member to move to the second position during the switchback transport. The first position is a position in which the guide member is retracted from a path of the recording paper on a downstream side from the rollers in the forward direction transport. The second position is a position in which the recording paper sandwiched between the rollers can be received on the guide member.

12 Claims, 4 Drawing Sheets

IMAGE FORMING APPARATUS

CROSS-REFERENCE TO RELATED APPLICATIONS

This application claims priority under 35 U.S.C. §119(a) on Patent Application No. 2010-057343 filed in Japan on Mar. 15, 2010, the entire contents of which are herein incorporated by reference.

BACKGROUND OF THE INVENTION

1. Field of the Invention

The present invention relates to image forming apparatus that carry out switchback transport for switching transport directions of recording papers.

2. Description of the Related Art

In this type of image forming apparatus, the transport directions of the recording papers are switched to selectively carry out printing on only the front surface (front side) of the recording papers and printing on both sides of the recording papers. When printing on only the front surface of the recording papers, the recording paper is immediately discharged after printing has been completed on the front surface of the recording paper. And when printing on both sides of the recording papers, transport of the recording paper is temporarily stopped after printing has been completed on the front surface of the recording paper, then the recording paper is transported in the reverse direction through a diversion path (switchback transport), and after the front and back of the recording paper have been turned over, printing is carried out on the back surface of the recording paper and the recording paper is discharged.

For example, a conventional electrophotographic image forming apparatus such as that shown in FIG. 5 is provided with a forward direction path 101 in which a recording paper P is transported in a forward direction, a diversion path 102 in which the recording paper P is transported in a reverse direction, pairs of transport rollers 103 arranged in multiple locations on the forward direction path 101 and the diversion path 102, a photosensitive drum 104 and a transfer roller 105, a heating roller 106 and a pressure roller 107, a pair of discharge rollers 108 arranged at the terminal end of the forward direction path 101, and a discharge tray 109. In this image forming apparatus, a toner image is formed on the surface of the photosensitive drum 104 while the recording paper P is transported along the forward direction path 101, then the recording paper P is sandwiched in a nip region between the photosensitive drum 104 and the transfer roller 105 to transfer the toner image on the surface of the photosensitive drum 104 onto the recording paper P, then the recording paper P is subjected to heat and pressure by being sandwiched in a nip region between the heating roller 106 and the pressure roller 107, thereby fixing the toner image onto the recording paper P. When performing printing on only the front surface of the recording paper P, the recording paper P is transported along the forward direction path 101 such that a toner image is recorded onto the front surface, then the recording paper P is discharged to the discharge tray 109 by the discharge rollers 108.

Furthermore, when printing on both surfaces of the recording paper P, after printing has been completed on the front surface of the recording paper P, rotation is temporarily stopped of the discharge rollers 108, which are sandwiching the recording paper P midway during discharge of the recording paper to the discharge tray 109, then the discharge rollers 108 are rotated in reverse to transport the recording paper P in the reverse direction and feed it to the diversion path 102 (switchback transport). This recording paper P is transported through the diversion path 102 and returned to the forward direction path 101 after its front and back are turned over, then it is again sandwiched in the nip region between the photosensitive drum 104 and the transfer roller 105, a toner image is recorded on its back surface, then it passes through the nip region between the heating roller 106 and the pressure roller 107, and is discharged to the discharge tray 109 by the discharge rollers 108.

Furthermore, in JP 2007-99480A, ribs that contact the recording papers in the forward direction path 101 and the diversion path 102 shown in FIG. 5 are formed so that the stress applied to the recording papers does not concentrate in a single location, thereby preventing noise and corner bending of the recording papers caused by contact between the recording papers and the ribs.

However, in conventional image forming apparatuses, when the rotation of the discharge rollers 108 is temporarily stopped to perform switchback transport, a phenomenon is produced that the leading edge (front edge) of the recording paper P being sandwiched between the discharge rollers 108 droops down on the discharge tray 109 side as shown in FIG. 6, and accompanying this the trailing edge of the recording paper P upwardly rises on the side opposite to the discharge tray 109 (the side of the forward direction path 101 and the diversion path 102). This phenomenon tends to occur particularly when the width of the nip region between the discharge rollers 108 is narrow, or when the discharge rollers 108 are provided in a divided manner with a space between the discharge rollers 108 in the lengthwise directions of the discharge rollers 108.

And when the recording paper P in this state is transported in the reverse direction, the raised trailing edge of the recording paper tends to catch on the ribs or the like in the forward direction path 101 and the diversion path 102, thereby producing noise or corner bending (dog ears) of the recording paper.

In JP 2007-99480A, although innovations are implemented in the formation of the ribs that contact the recording papers in the forward direction path 101 and the diversion path 102, these innovations do not extend to preventing the trailing edge of the recording papers from contacting or catching on the ribs or the like of the forward direction path 101 and the diversion path 102 during switchback transport, and it has not been possible to prevent the noise and corner bending of recording papers that accompanies switchback transport.

SUMMARY OF THE INVENTION

The present invention has been devised to address the above-described issues, and it is an object thereof to provide an image forming apparatus that is capable of preventing the trailing edge of recording papers from contacting or catching on the ribs or the like on the paths of the recording papers during switchback transport.

In order to address these issues, an image forming apparatus according to the present invention is directed to an image forming apparatus that is provided with a pair of rollers that rotate, and that selectively carries out forward direction transport in which a recording paper is sandwiched and transported (in a forward direction) between the rollers, and switchback transport in which the transport direction of the recording paper is switched to a reverse direction (the recording paper is transported in a reverse direction to the forward direction) by causing the rollers to temporarily stop and then rotate in reverse during transport of the recording paper. The image forming apparatus is provided with a guide member that is provided at a downstream side from the rollers in the forward direction transport and that moves to either a first position or a second position, and a control portion that causes the guide member to move to the first position during the forward direction transport and causes the guide member to move to the second position during the switchback transport. The first position is a position in which the guide member is retracted from a path of the recording paper on a downstream side from the rollers in the forward direction transport, and the second position is a position in which the recording paper sandwiched between the rollers can be received on the guide member.

With this invention, the first position is a position in which the guide member is retracted from the path of the recording papers, and therefore the guide member does not interfere with the transport of the recording papers. Furthermore, the second position is a position in which the recording paper sandwiched between the rollers can be received on the guide member. Accordingly, the recording paper sandwiched between the rollers is received on the guide member and does not droop down. Thus, the recording paper does not upwardly rise on the opposite side to the guide member, and the trailing edge of the recording paper facing the reverse direction does not contact or catch on the ribs or the like of the transport path when the recording paper is transported in the reverse direction due to switchback transport, and thus no noise or corner bending of the recording paper is produced.

In an image forming apparatus according to one embodiment of the present invention, it is preferable that a discharge tray is further provided, and that the rollers are discharge rollers, the forward direction transport includes transporting by sandwiching the recording paper on which printing has been performed between the discharge rollers for discharge to the discharge tray, the first position is a position in which the guide member is retracted from a discharge path of the recording paper from the discharge rollers to the discharge tray, and the second position is higher than the discharge tray.

That is, an image forming apparatus according to one embodiment of the present invention is directed to an image forming apparatus that is provided with a pair of discharge rollers that rotate, and a discharge tray, and that selectively carries out forward direction transport in which a recording paper on which printing has been performed is sandwiched and transported between the discharge rollers and discharged to the discharge tray, and switchback transport in which the transport direction of the recording paper is switched to a reverse direction by causing the discharge rollers to temporarily stop and then rotate in reverse during transport of the recording paper. The image forming apparatus is provided with a guide member that is provided at a downstream side from the discharge rollers in the forward direction transport and that moves to either a first position or a second position, and a control portion that causes the guide member to move to the first position during the forward direction transport and causes the guide member to move to the second position during the switchback transport. The first position is a position in which the guide member is retracted from a discharge path of the recording paper from the discharge rollers to the discharge tray, and the second position is higher than the discharge tray and is a position in which the recording paper sandwiched between the discharge rollers can be received on the guide member.

In this way, the guide member is caused to move to the first position during forward direction transport of the recording paper, and the guide member is caused to move to the second position during switchback transport. The first position is a position in which the guide member is retracted from the discharge path of the recording papers to the discharge tray, and therefore the guide member does not interfere with the discharge of the recording papers. Furthermore, the second position is a position in which the recording paper sandwiched between the discharge rollers can be received on the guide member. Accordingly, the recording paper sandwiched between the discharge rollers is received on the guide member and does not droop down. Thus, the recording paper does not upwardly rise on the opposite side to the guide member, and the trailing edge of the recording paper facing the reverse direction does not contact or catch on the ribs or the like of the transport path when the recording paper is transported in the reverse direction due to switchback transport, and thus no noise or corner bending of the recording paper is produced.

Furthermore, in an image forming apparatus according to one embodiment of the present invention, at a time of the forward direction transport, the recording paper on which printing has been performed (on one surface) is guided to the discharge rollers via a forward-direction transport path, and at a time of the switchback transport, the recording paper is again guided to the forward-direction transport path from the discharge rollers via a diversion path, which is different from the forward-direction transport path, and a back and front of the recording paper are turned over, and printing is performed on a back surface (the surface that has not been printed) of the recording paper.

That is, switchback transport is performed to again guide the recording paper from the discharge rollers to the forward-direction transport path via the diversion path, which is different from the forward-direction transport path, so as to carry out printing on the back surface of the recording paper. In this embodiment it is preferable that the forward direction transport is carried out after printing is performed on the back surface of the recording paper. This enables the guide member to avoid interfering with the discharge of the recording papers when the recording papers on which printing has been performed on both sides are discharged to the discharge tray.

Furthermore, in an image forming apparatus according to one embodiment of the present invention, at a time of the forward direction transport, the recording paper on which printing has been performed is guided to the discharge rollers via a forward-direction transport path, and at a time of the switchback transport, the recording paper is discharged from the discharge rollers via the diversion path, which is different from the forward-direction transport path, to a different discharge tray from the discharge tray.

That is, switchback transport is performed to discharge the recording paper from the discharge rollers to a different discharge tray via the diversion path, which is different from the forward-direction transport path.

For example, the guide member is a guide board capable of rotating about a shaft, the control portion causes the guide board to move to either a first position or a second position by causing the guide board to rotate about the shaft, and causes the guide board to move to either the first position or the second position due to rotation about the shaft.

Furthermore, in an image forming apparatus according to one embodiment of the present invention, when the guide board is in the second position, an upper surface of the guide board contacts a lower surface of the recording paper, and when the guide board is in the first position, an end of the guide board which is farther from the shaft is in a position lower than a position of the end when the guide board is in the second position. In this embodiment, during switchback transport, the recording paper is supported from below by the guide board, thereby very reliably enabling avoidance of the recording paper drooping down. Accordingly, the trailing edge of the recording paper can be very reliably prevented from contacting or catching on the ribs or the like of the recording paper paths during switchback transport. Furthermore, during forward direction transport, the guide member can be retracted from the discharge path of the recording papers to the discharge tray that extends diagonally downward from the discharge rollers, and therefore it is possible to very reliably avoid the guide member from interfering with the discharge of the recording papers.

Furthermore, in an image forming apparatus according to one embodiment of the present invention, the shaft is provided parallel at one end of the guide board and in parallel to the rollers, and the end is closer to the rollers. In this embodiment, the shaft of the guide member is arranged in a position and with an orientation such that interference with the discharge of the recording papers is unlikely, and therefore it is possible to even more reliably avoid the guide member interfering with the discharge of the recording papers.

Furthermore, in an image forming apparatus according to one embodiment of the present invention, prior to the switchback transport, the recording paper is guided to the discharge rollers via the forward-direction transport path, and the control portion keeps the guide member in the second position in a period from a time point when a leading edge of the recording paper has arrived at the discharge rollers until a time point when the switchback transport commences. In this embodiment, the recording paper sandwiched between the discharge rollers for switchback transport is constantly received on the guide member until switchback transport is completed, and there is no drooping down. Thus, the trailing edge of the recording paper can be very reliably prevented from contacting or catching on the ribs or the like of the recording paper paths during switchback transport.

DETAILED DESCRIPTION OF THE INVENTION

Hereinafter, embodiments of the present invention are described in detail with reference to the accompanying drawings.

Figure 1:
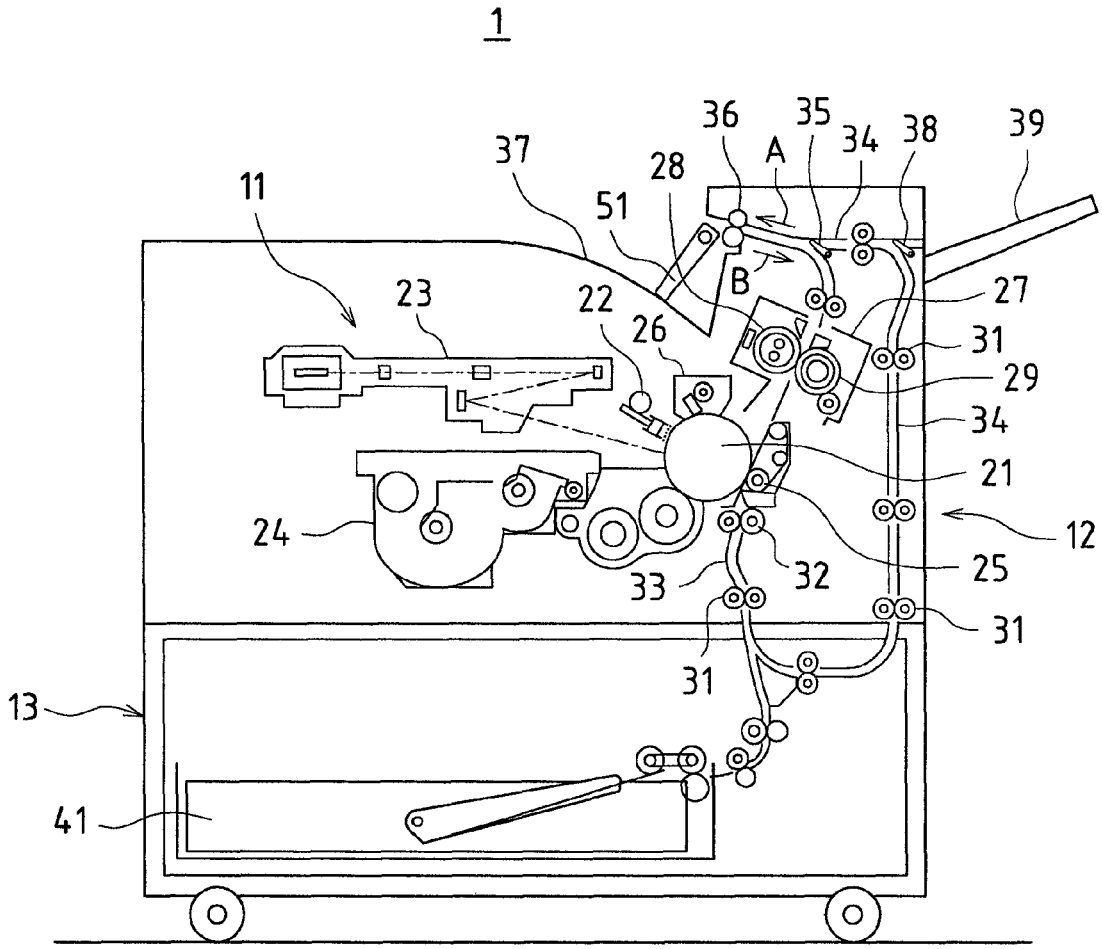
FIG. 1 is a cross-sectional view showing one embodiment of an image forming apparatus according to the present invention.

FIG. 1 is a cross-sectional view showing one embodiment of an image forming apparatus according to the present invention. An image forming apparatus 1 according to the present embodiment prints a monochrome image, which is indicated by image data, onto a recording paper, and its structure can be broadly divided into a printer portion 11, a recording paper transport portion 12, and a paper feeding portion 13.

In this image forming apparatus 1, image data is received from outside, then after various types of image processing are executed on the image data, the image data is inputted to the printer portion 11, and an image indicated by the image data is printed onto a recording paper by the printer portion 11.

A photosensitive drum 21 is arranged substantially centrally in the printer portion 11, and a charging device 22, an optical scanning device 23, a development device 24, a transfer roller 25, and a cleaning device 26 are arranged therearound.

The photosensitive drum 21 rotates in one direction and after its surface is cleaned by the cleaning device 26, this surface is uniformly charged by the charging device 22. The charging device 22 may be a charger type unit or may be a roller type or brush type unit that makes contact with the photosensitive drum 21. The optical scanning device 23 writes an electrostatic latent by inputting the image data then scanning an optical beam on the uniformly charged surface of the photosensitive drum 21 while modulating the intensity of the optical beam in response to the image data. The development device 24 uses toner to make visible the electrostatic latent image on the surface of the photosensitive drum 21, thereby forming a toner image on the surface of the photosensitive drum 21.

The transfer roller 25 presses against the photosensitive drum 21 to form a nip region between itself and the photosensitive drum 21, and then rotates with the photosensitive drum 21 so that the toner image on the surface of the photosensitive drum 21 is transferred onto the recording paper while the recording paper is transported sandwiched in that nip region.

The cleaning device 26 removes any toner that is residual on the surface of the photosensitive drum 21, thereby enabling a new toner image to be formed on the surface of the photosensitive drum 21.

A fixing device 27 is arranged at an upper side of the printer portion 11. The fixing device 27 is provided with a heating roller 28 and a pressure roller 29 that press against each other, and sandwiches the recording paper in a nip region between the heating roller 28 and the pressure roller 29, thereby applying heat and pressure to the recording paper and causing the toner image that has been transferred onto the recording paper to become fixed.

The recording paper transport portion 12 is provided with components such as a plurality of pairs of transport rollers 31 for transporting the recording papers, a pair of registration rollers 32, a forward-direction transport path 33, a diversion path 34, branching claws 35 and 38, and a pair of discharge rollers 36.

Furthermore, the paper feeding portion 13 is provided with a paper feed tray 41. The paper feed tray 41 is a tray for storing recording papers and is provided in a lower portion of the image forming apparatus 1. Furthermore, the paper feed tray 41 is provided with a pickup roller or the like for withdrawing the recording papers sheet by sheet, and a recording paper that has been withdrawn is fed to the forward-direction transport path 33 of the recording paper transport portion 12.

In the forward-direction transport path 33, the recording paper is received from the paper feeding portion 13 and transported to the registration rollers 32 such that the leading edge of the recording paper strikes the temporarily stopped registration rollers 32 thereby causing the recording paper to bend, then due to an elastic force of the recording paper, the leading edge of the recording paper becomes aligned parallel to the registration rollers 32, after which rotation of the registration rollers 32 commences, and the recording paper is transported by the registration rollers 32 to the nip region between the photosensitive drum 21 and the transfer roller 25. A toner image is transferred onto the recording paper by the recording paper passing through the nip region between the photosensitive drum 21 and the transfer roller 25, and the toner image is fixed by the recording paper passing through the nip region between the heating roller 28 and the pressure roller 29, then the recording paper is transported in a forward direction A by the discharge rollers 36 to be discharged to a discharge tray 37.

Furthermore, in a case where an image is to be printed also on the back surface of the recording paper, the recording paper is transported in the forward direction A then the discharge rollers 36 are stopped midway during discharge of the recording paper to the discharge tray 37, that is, the discharge rollers 36 are stopped in a state in which they are sandwiching the recording paper, then after the branching claw 35 is switched to a diagonally downward orientation, the discharge rollers 36 are rotated in reverse, thereby transporting the recording paper in a reverse direction B and guiding it to the diversion path 34, then the recording paper is again guided to the forward-direction transport path 33 via the diversion path 34, thereby returning the recording paper to the registration rollers 32.

This manner of switching the transport direction of the recording paper is referred to as switchback transporting, and due to this switchback transporting the front and back of the recording paper are turned over, and at the same time the leading edge and the trailing edge of the recording paper are swapped. Accordingly, when the recording paper is turned over and returned, the trailing edge of the recording paper makes contact with the registration rollers 32 such that the trailing edge of the recording paper aligns parallel to the registration rollers 32, then the recording paper is transported, with its trailing edge in the lead, by the registration rollers 32 to the nip region between the photosensitive drum 21 and the transfer roller 25, and printing is carried out on the back surface of the recording paper, then the toner image is fixed to the back surface of the recording paper by the heating roller 28 and the pressure roller 29, and the recording paper is discharged to the discharge tray 37 by way of the discharge rollers 36.

Furthermore, switchback transport is carried out not only when the front and back of the recording paper are to be turned over, but also when the recording paper is to be discharged to an external discharge tray 39 provided at a right side lateral wall of the image forming apparatus 1. In this case, the recording paper is transported in the forward direction A then the discharge rollers 36 are stopped midway during discharge of the recording paper to the discharge tray 37, then after the branching claws 35 and 38 are both switched to diagonally downward orientations, the discharge rollers 36 are rotated in reverse, thereby transporting the recording paper in the reverse direction B and discharging it to the external discharge tray 39 via a portion of the diversion path 34.

In this regard, during switchback transport in the image forming apparatus 1, the discharge rollers 36 are temporarily stopped and then rotated in reverse to transport the recording paper in the reverse direction B, but if the phenomenon occurs in which when the discharge rollers 36 are temporarily stopped, the leading edge of the recording paper sandwiched between the discharge rollers 36 droops down on the discharge tray 37 side and the trailing edge of the recording paper upwardly rises on the side opposite to the discharge tray 37 (the side of the forward-direction transport path 33 and the diversion path 34), then when the recording paper is transported in the reverse direction B, the raised trailing edge of the recording paper will catch on the ribs or the like of the forward-direction transport path 33 and the diversion path 34, thereby causing noise and corner bending in the recording papers.

Accordingly, the present embodiment is configured such that when the discharge rollers 36 are temporarily stopped, the leading edge of the recording paper sandwiched between the discharge rollers 36 is prevented in advance from drooping down on the discharge tray 37 side so that the trailing edge of the recording paper does not upwardly rise on the side opposite to the discharge tray 37, and the trailing edge of the recording paper does not catch on the ribs or the like of the forward-direction transport path 33 and the diversion path 34 when the recording paper is transported in the reverse direction B.

Figure 2:
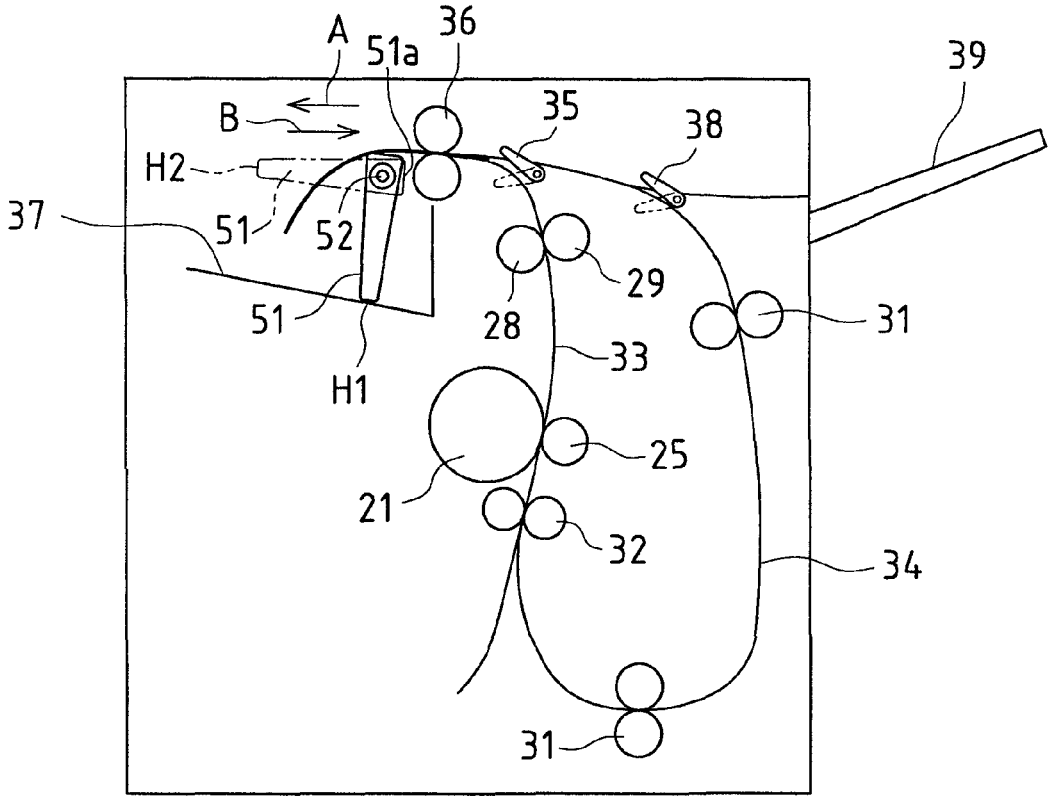
FIG. 2 is a simplified cross-sectional view of the vicinity of a discharge tray, a forward-direction transport path, and a diversion path in the image forming apparatus of FIG. 1.

Next, description is given of a configuration for preventing in advance the recording paper from drooping down on the discharge tray 37 side. FIG. 2 is a simplified cross-sectional view of the vicinity of the discharge tray 37, the forward-direction transport path 33, and the diversion path 34.

In the present embodiment, a guide board (guide member) 51 is disposed above the discharge tray 37 as shown in FIG. 2, and a shaft 52 that is parallel to the discharge rollers 36 is provided at one end 51*a* of the guide board 51 so that the one end 51*a* of the guide board 51 is pivotably supported by the shaft 52, and the guide board 51 is supported so as to be capable of rotating in a reciprocating manner about the shaft 52, and the guide board 51 is selectively caused to rotationally move to either a first position H1, which is shown by a solid line, or a second position H2, which is shown by a dashed double-dotted line. Furthermore, the one end 51*a* of the guide board 51 is positioned lower than the nip region of the discharge rollers 36, and the guide board 51 is configured so as to not impede the transport of recording papers P from the discharge rollers 36.

In a state in which the guide board 51 has moved to the first position H1, the orientation of the guide board 51 from the one end 51*a* toward the other end (the end which is farther from the shaft 52) is directed downward, and the guide board 51 is retracted from the discharge path of the recording papers P from the discharge rollers 36 to the discharge tray 37. In this state, so that the guide board 51 does not contact the recording paper P, the other end of the guide board 51 is in a lower position than when the guide board 51 is in the second position H2. And this state is set in periods other than periods in which switchback transport is executed so that the recording papers P are transported in the forward direction A and discharged from the discharge rollers 36 to the discharge tray 37.

That is, in periods other than periods in which switchback transport is executed, the guide board 51 is in a position retracted from the discharge path of the recording papers P, and the recording papers P are swiftly discharged from the discharge rollers 36 to the discharge tray 37.

Furthermore, in a state in which the guide board 51 has moved to the second position H2, the orientation of the guide board 51 from the one end 51*a* toward the other end is directed in a horizontal orientation, and the guide board 51 is positioned slightly lower than the nip region of the discharge rollers 36 and above the discharge tray 37. The upper surface of the guide board 51 is configured as a smooth surface that is parallel to the transport direction (in this example, a substantially horizontal direction) of the recording papers P at the nip region between the discharge rollers 36. Furthermore, the upper surface of the guide board 51 is configured so as to contact the lower surface of the leading edge side portion of the recording paper P (downstream side in the forward direction A from the nip region between the discharge rollers 36), which is sandwiched by the temporarily stopped discharge rollers 36, thereby receiving this leading edge side portion. The dimension of the upper surface of the guide board 51 along the forward direction A is not less than one half the dimension of the leading edge side portion of the recording paper P along the forward direction A (approximately two-thirds in this example). And this state is set in periods in which switchback transport is executed, that is, in periods from immediately prior to the stopping of the discharge rollers 36 sandwiching the recording paper P until immediately after reverse rotation of the discharge rollers 36.

Figure 3:
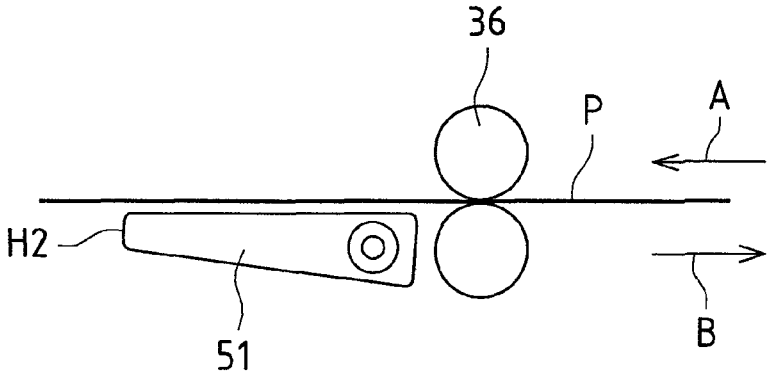
FIG. 3 is a diagram showing a state in the image forming apparatus of FIG. 1 in which a recording paper is sandwiched between discharge rollers.

In this case, as shown in FIG. 3, the leading edge of the recording paper P sandwiched between the discharge rollers 36 is placed on the guide board 51 such that it does not droop down on the discharge tray 37 side. Thus, the trailing edge of the recording paper P does not upwardly rise on the opposite side to the discharge tray 37 and the trailing edge of the recording paper P does not catch on the ribs or the like of the forward-direction transport path 33 and the diversion path 34 when the recording paper P is transported in the reverse direction B.

It should be noted that after the discharge rollers 36 are rotated in reverse to transport the recording paper P in the reverse direction B and guide it to the diversion path 34, the discharge rollers 36 are caused to rotate in the original forward direction and the guide board 51 is caused to move to the first position H1 such that the recording papers P are swiftly discharged from the discharge rollers 36 to the discharge tray 37.

Figure 4:
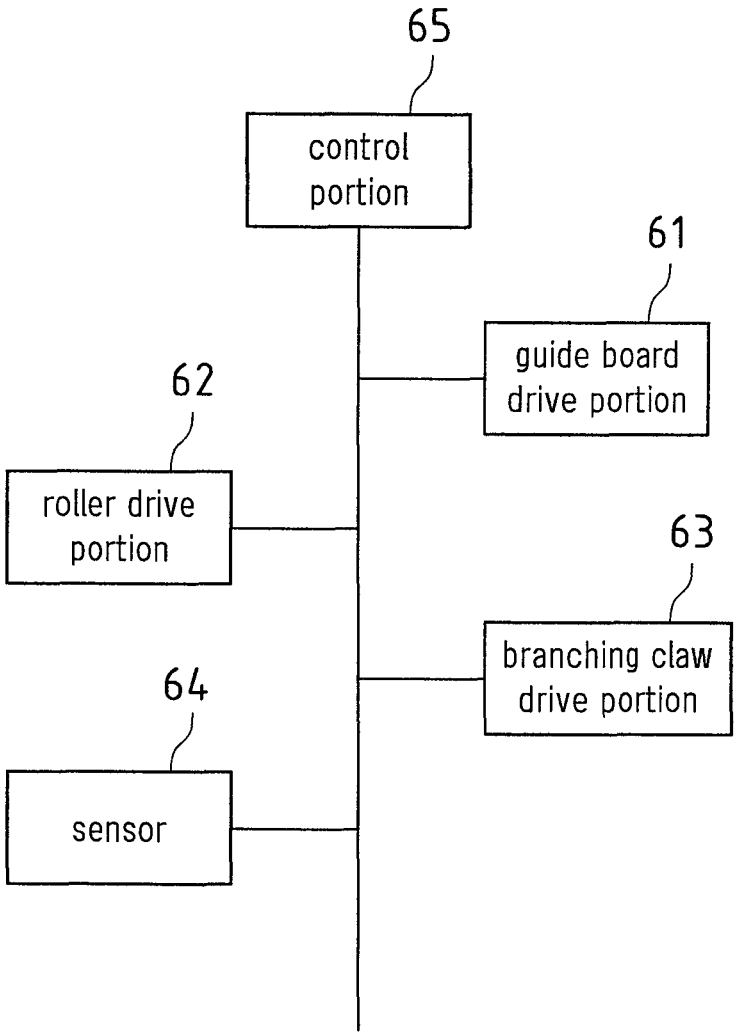
FIG. 4 is a block diagram showing a control system for controlling movement and the like of the guide board of FIG. 2.
Figure 5:
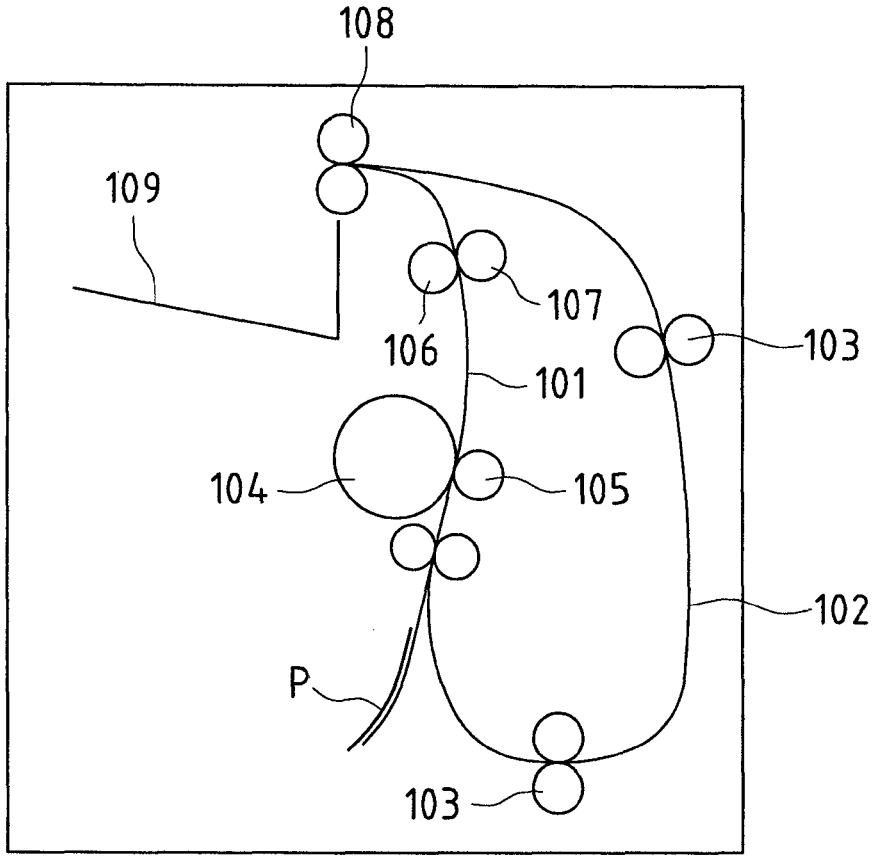
FIG.5 Prior Art
FIG. 5 is a simplified cross-sectional view of a conventional image forming apparatus.
Figure 6:
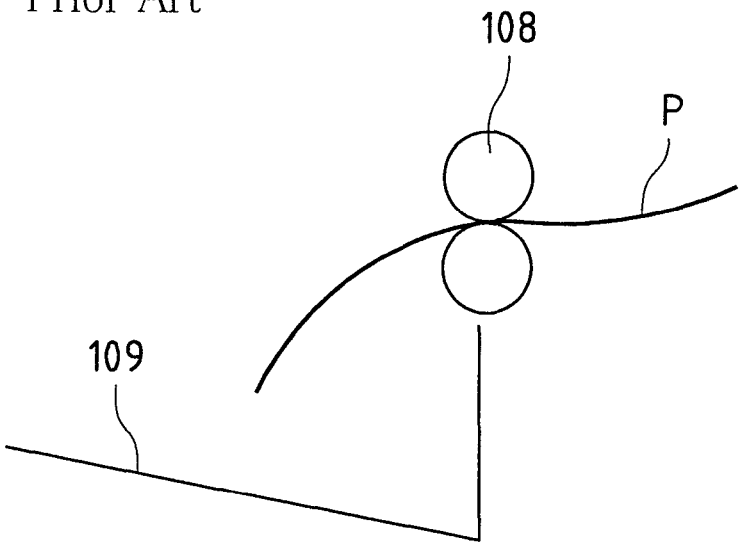
FIG.6 Prior Art
FIG. 6 is a diagram showing a state in a conventional image forming apparatus in which a leading edge side of a recording paper sandwiched between the discharge rollers droops down and a trailing edge side of the recording paper has risen.

FIG. 4 is a block diagram showing a control system for controlling movement and the like of the guide board 51. In regard to FIG. 4, a guide board drive portion 61 is provided with a power transmission mechanism (not shown in the drawing) including a motor and gears or the like, and this transmits a rotational drive force to the shaft 52 of the guide board 51 such that the guide board 51 rotates in a reciprocating manner about the shaft 52 and becomes positioned at either the first position H1 or the second position H2.

A roller drive portion 62 is provided with a power transmission mechanism (not shown in the drawing) including a motor, a clutch, and gears or the like, and this switches between causing stopping, forward direction rotation, and reverse direction rotation of the discharge rollers 36. Furthermore, the roller drive portion 62 is not only for rotationally driving the discharge rollers 36 but also functions to rotationally drive the transport rollers 31 and the registration rollers 32.

A branching claw drive portion 63 switches the branching claws 35 and 38 between the positions indicated by the solid lines and the dotted lines respectively. A sensor 64 detects positions of the recording paper P at multiple locations on the forward-direction transport path 33 and the diversion path 34.

The control portion 65 controls the roller drive portion 62 based on the multiple locations of positions of the recording paper P detected by the sensor 64 to selectively cause rotation or stopping of the discharge rollers 36, the transport rollers 31, and the registration rollers 32, and controls the branching claw drive portion 63 to switch the branching claws 35 and 38 to cause the recording papers P to be transported through the forward-direction transport path 33 or the diversion path 34.

Furthermore, the control portion 65 controls the guide board drive portion 61 to cause the guide board 51 to rotate in a reciprocating manner about the shaft 52, thereby selectively causing the guide board 51 to move to either the first position H1 or the second position H2.

For example, the control portion 65 monitors the switchback transport in the image forming apparatus 1, and causes the guide board 51 to move to the second position H2 only during execution of switchback transport to ensure that the leading edge of the recording paper P sandwiched between the discharge rollers 36 does not droop down and that its trailing edge does not rise, such that the trailing edge of the recording paper P does not catch on the ribs or the like when the recording paper P is transported in the reverse direction B.

Furthermore, the control portion 65 causes the guide board 51 to move to the first position H1 in periods other than periods in which switchback transport is executed so that the recording papers P are transported in the forward direction A and swiftly discharged from the discharge rollers 36 to the discharge tray 37.

Specifically, in the image forming apparatus 1, printing on only the front surface of the recording paper P, double sided printing, and discharge to the external discharge tray 39 are instructed by operations by a user at an input operation portion (not shown in drawings), and positions of the recording paper P at multiple locations on the forward-direction transport path 33 and the diversion path 34 are detected by the sensor 64, and therefore the control portion 65 determines periods in which switchback transport is executed based on which of printing on only the front surface of the recording paper P, double sided printing, and discharge to the external discharge tray 39 has been instructed as well as positions of the recording paper P detected by the sensor 64, and controls the guide board drive portion 61 to cause the guide board 51 to move to the second position H2 during periods of execution of switchback transport and to cause the guide board 51 to move to the first position H1 in periods other than periods of execution of switchback transport.

For example, if printing on only the front surface of the recording paper P has been instructed, the control portion 65 controls the guide board drive portion 61 to cause the guide board 51 to move to the first position H1 where it is retracted from the discharge path of the recording papers P. In this state, the recording papers P are swiftly discharged by way of the discharge rollers 36 from the forward-direction transport path 33 to the discharge tray 37.

Furthermore, if double sided printing of the recording paper P has been instructed, at a time point when printing on the front surface of the recording paper P has been completed and the sensor 64 has detected the position of the recording paper P as being just before the discharge rollers 36, the control portion 65 controls the guide board drive portion 61 to cause the guide board 51 to move to the second position H2 such that the guide board 51 is directed in a horizontal direction. Accordingly, the control portion 65 causes the guide board 51 to move to the second position H2 before the leading edge of the recording paper P arrives at the discharge rollers 36. In this state, the recording paper P, on which printing has been completed on its front surface, passes through the discharge rollers 36 and the leading edge side of this recording paper P becomes placed on the guide board 51.

Then, at a time prior to the recording paper P fully passing through the discharge rollers 36, the control portion 65 controls the roller drive portion 62 to cause the discharge rollers 36 to stop, then causes the discharge rollers 36 to rotate in reverse such that the recording paper P is transported by the discharge rollers 36 in the reverse direction B. In the period from the time point when the leading edge of the recording paper P has arrived at the discharge rollers 36 until the discharge rollers 36 are stopped, the period from the time point when the discharge rollers 36 have been stopped until the time point when reverse direction B transport (switchback transport) of the recording paper P commences by the discharge rollers 36, and the period in which reverse direction B transport of the recording paper P is being carried out by the discharge rollers 36, the control portion 65 keeps the guide board 51 in the second position H2. At this time, the leading edge side of the recording paper P sandwiched between the discharge rollers 36 is placed on the guide board 51, and therefore the trailing edge of the recording paper P does not upwardly rise on the opposite side to the discharge tray 37. Thus, the trailing edge of the recording paper P does not catch on the ribs or the like of the forward-direction transport path 33 and the diversion path 34 when the recording paper P is transported in the reverse direction B.

At the same time, the control portion 65 controls the branching claw drive portion 63 to switch the branching claw 35 to the position indicated by the dotted line. Thus, the recording paper P is transported in the reverse direction B and guided to the diversion path 34, then again guided to the forward-direction transport path 33 via the diversion path 34 such that its front and back are turned over and it returns to the registration rollers 32.

After this, the control portion 65 controls the guide board drive portion 61 such that the guide board 51 returns to the first position H1, and controls the branching claw drive portion 63 such that the branching claw 35 returns to the position of the solid line.

Thus, after images have been printed on its front and back by being transported via the registration rollers 32, then via the nip region between the photosensitive drum 21 and the transfer roller 25 and then via the nip region between the heating roller 28 and the pressure roller 29, the recording paper P is discharged by the discharge rollers 36 to the discharge tray 37.

Furthermore, if discharge to the external discharge tray 39 has been instructed, at a time point when the sensor 64 detects the position of the recording paper P as being just before the discharge rollers 36, the control portion 65 controls the guide board drive portion 61 to cause the guide board 51 to move to the second position H2 such that the guide board 51 is directed in a horizontal direction.

Then, at a time prior to the recording paper P fully passing through the discharge rollers 36, the control portion 65 controls the roller drive portion 62 to cause the discharge rollers 36 to stop, then causes the discharge rollers 36 to rotate in reverse such that the recording paper P is transported by the discharge rollers 36 in the reverse direction B. At this time, the leading edge side of the recording paper P sandwiched between the discharge rollers 36 is placed on the guide board 51, and therefore the trailing edge of the recording paper P does not upwardly rise on the opposite side to the discharge tray 37. Thus, the trailing edge of the recording paper P does not catch on the ribs or the like of the forward-direction transport path 33 and the diversion path 34 when the recording paper P is transported in the reverse direction B.

At the same time, the control portion 65 controls the branching claw drive portion 63 to switch the branching claws 35 and 38 to the positions indicated by the dotted lines. Thus, the recording paper P is transported in the reverse direction B and guided to the diversion path 34, then discharged to the external discharge tray 39 via a portion of the diversion path 34.

After this, the control portion 65 controls the guide board drive portion 61 such that the guide board 51 returns to the first position H1, and controls the branching claw drive portion 63 such that the branching claws 35 and 38 return to the positions of the solid lines.

In this way, in the present embodiment, the guide board 51 is caused to move to the first position H1 during forward direction transport of the recording paper P, and the guide board 51 is caused to move to the second position H2 during switchback transport. The first position H1 is a position in which the guide board 51 is retracted from the discharge path of the recording papers P to the discharge tray 37, and the guide board 51 does not interfere with the transport of the recording papers P. Furthermore, the second position H2 is a position in which the leading edge side of the recording paper P sandwiched between the discharge rollers 36 can be received on the guide board 51. Accordingly, during switchback transport, the leading edge side of the recording paper P sandwiched between the discharge rollers 36 is received on the guide board 51 such that the leading edge side of the recording paper P does not droop down. Thus, there is also no upward rise of the trailing edge side of the recording paper P, and the trailing edge of the recording paper P does not catch on the ribs or the like of the forward-direction transport path 33 and the diversion path 34 when the recording paper P is transported in the reverse direction B due to switchback transport.

Embodiments of the present invention are described in detail above. However, the above-described embodiments are considered in all respects as simply illustrative and the present invention is not limited to the above-described embodiments. The scope of the invention is indicated by the appended claims rather than by the foregoing description. The present invention can be embodied and practiced in other different forms without departing from the spirit and essential characteristics thereof. Further still, modifications and variations within an equivalent scope of the appended claims, that is, design modifications and the like that do not depart from the gist of the present invention are included within the scope of the present invention.

What is claimed is:

1. An image forming apparatus that is provided with a pair of rollers that rotate, and that selectively carries out forward direction transport in which a recording paper is sandwiched and transported between the rollers, and switchback transport in which the transport direction of the recording paper is switched to a reverse direction by causing the rollers to temporarily stop and then rotate in reverse during transport of the recording paper, comprising:

a guide member that is provided at a downstream side from the rollers in the forward direction transport and that moves to either a first position or a second position, and a control portion that causes the guide member to move to the first position during the forward direction transport and causes the guide member to move to the second position during the switchback transport, wherein the first position is a position in which the guide member is retracted from a path of the recording paper on a downstream side from the rollers in the forward direction transport, and the second position is a position in which the recording paper sandwiched between the rollers can be received on the guide member, wherein the guide member is a guide board capable of rotating about a shaft, and the control portion causes the guide board to move to either a first position or a second position by causing the guide board to rotate about the shaft, wherein, when the guide board is in the second position, an upper surface of the guide board contacts a lower surface of the recording paper, and when the guide board is in the first position, an end of the guide board which is farther from the shaft is in a position lower than a position of the end when the guide board is in the second position.

2. The image forming apparatus according to claim 1, further comprising a discharge tray, wherein the rollers are discharge rollers, the forward direction transport includes transporting by sandwiching the recording paper on which printing has been performed between the discharge rollers for discharge to the discharge tray, the first position is a position in which the guide member is retracted from a discharge path of the recording paper from the discharge rollers to the discharge tray, and the second position is higher than the discharge tray.

3. The image forming apparatus according to claim 2, wherein, at a time of the forward direction transport, the recording paper on which printing has been performed is guided to the discharge rollers via a forward-direction transport path, and at a time of the switchback transport, the recording paper is again guided to the forward-direction transport path from the discharge rollers via a diversion path, which is different from the forward-direction transport path, and a back and front of the recording paper are turned over, and printing is performed on a back surface of the recording paper.

4. The image forming apparatus according to claim 3, wherein the forward direction transport is carried out after printing is performed on the back surface of the recording paper.

5. The image forming apparatus according to claim 2, wherein, at a time of the forward direction transport, the recording paper on which printing has been performed is guided to the discharge rollers via the forward-direction transport path, and at a time of the switchback transport, the recording paper is discharged from the discharge rollers via the diversion path, which is different from the forward-direction transport path, to a different discharge tray from the discharge tray.

6. The image forming apparatus according to claim 2, wherein the guide member is a guide board capable of rotating about a shaft, and the control portion causes the guide board to move to either a first position or a second position by causing the guide board to rotate about the shaft.

7. The image forming apparatus according to claim 3, wherein the guide member is a guide board capable of rotating about a shaft, and the control portion causes the guide board to move to either a first position or a second position by causing the guide board to rotate about the shaft.

8. The image forming apparatus according to claim 4, wherein the guide member is a guide board capable of rotating about a shaft, and the control portion causes the guide board to move to either a first position or a second position by causing the guide board to rotate about the shaft.

9. An image forming apparatus that is provided with a pair of rollers that rotate, and that selectively carries out forward direction transport in which a recording paper is sandwiched and transported between the rollers, and switchback transport in which the transport direction of the recording paper is switched to a reverse direction by causing the rollers to temporarily stop and then rotate in reverse during transport of the recording paper, comprising:

a guide member that is provided at a downstream side from the rollers in the forward direction transport and that moves to either a first position or a second position, and a control portion that causes the guide member to move to the first position during the forward direction transport and causes the guide member to move to the second position during the switchback transport, wherein the first position is a position in which the guide member is retracted from a path of the recording paper on a downstream side from the rollers in the forward direction transport, and the second position is a position in which the recording paper sandwiched between the rollers can be received on the guide member, wherein the guide member is a guide board capable of rotating about a shaft, and the control portion causes the guide board to move to either a first position or a second position by causing the guide board to rotate about the shaft, and wherein the shaft is provided parallel at one end of the guide board and in parallel to the rollers, and the end is closer to the rollers.

10. The image forming apparatus according to claim 1, wherein, prior to the switchback transport, the recording paper is guided to the discharge rollers via the forward-direction transport path, and the control portion keeps the guide member in the second position in a period from a time point when a leading edge of the recording paper has arrived at the discharge rollers until a time point when the switchback transport commences.

11. The image forming apparatus according to claim 1, wherein the rollers comprise an upper roller and a lower roller, and the shaft is located approximately in the same horizontal plane as the lower roller.

12. The image forming apparatus according to claim 9, wherein the rollers comprise an upper roller and a lower roller, and the shaft is located approximately in the same horizontal plane as the lower roller.

* * * * *